United States Patent [19]

Oka

[11] Patent Number: 5,048,450

[45] Date of Patent: Sep. 17, 1991

[54] SEAT LATCH FOR WATERCRAFT

[75] Inventor: Katsunori Oka, Iwata, Japan

[73] Assignee: Yamaha Hatsudoki Kabushiki Kaisha, Iwata, Japan

[21] Appl. No.: 450,608

[22] Filed: Dec. 13, 1989

[30] Foreign Application Priority Data

Dec. 14, 1988 [JP] Japan ..... 63-317042

[51] Int. Cl.[5] ..... B63B 35/84

[52] U.S. Cl. ..... 114/363; 114/270; 297/193

[58] Field of Search ..... 114/363, 270, 343; 297/188, 192, 193, 195, 311; 220/4.22, 7, 212, 244, 245, 252, 315, 324, 334

[56] References Cited

U.S. PATENT DOCUMENTS 3,718,365 2/1973 Gibson ..... 114/363

3,726,249 4/1973 Watkins ..... 114/270

FOREIGN PATENT DOCUMENTS 8803109 5/1988 World Int. Prop. O. ..... 114/270

OTHER PUBLICATIONS

Ski Horse, 10/19/84, Ski Horse of Penna., Johnstown, Pa.

Seat Frame, SBLP-186, Fab Tech, Cape Coral, Fla., 10/17/88.

*Primary Examiner*—Sherman Basinger

*Assistant Examiner*—Stephen P. Avila

*Attorney, Agent, or Firm*—Ernest A. Beutler

[57] ABSTRACT

A small watercraft having a detachable seat that is affixed to the hull by a latching mechanism that is positioned at the rear of the seat and which is operated by an operator accessible at the side of the seat and by a rider seated on the seat when he is positioned thereon.

7 Claims, 4 Drawing Sheets

SEAT LATCH FOR WATERCRAFT

BACKGROUND OF THE INVENTION

This invention relates to a seat latch for watercraft and more particularly to an improved and simplified arrangement for latching a seat to the hull of a watercraft and for affording access to the latching mechanism.

There is a popular type of small watercraft that is propelled by a jet propulsion unit and which is operated by a single rider seated in straddle fashion on a seat. The seat is normally removeable from the hull so as to afford access either to a storage compartment and/or to mechanical components of the watercraft for their servicing. Normally this type of seat latch is mounted at the rear of the seat and must be released by the operator being positioned at the rear of the seat. There are times, however, where it is desirable for the operator to be able to release the seat latch even when he is still seated on the seat. This is particularly true since it may be necessary for the rider to open the seat at a time when the watercraft is at sea.

It is, therefore, a principal object to this invention to provide a improved seat latch for a small watercraft and an actuating mechanism therefore.

It is a further object to this invention to provide a seat latch for a small watercraft that is accessible and operable from the side rather from the rear of the seat.

SUMMARY OF THE INVENTION

A first feature of the invention is adapted to be embodied in a small watercraft comprised of a hull portion defining a rider's area at the rear of the hull portion. A seat is detachably connected to the hull portion in the rider's area and is adapted to accommodate a rider seated there upon. Releasable latching means detachably secure the seat to the hull portion and operating means are provided for releasing the latching means which are accessible by a rider seated upon the seat.

Another feature of the invention is also adapted to be embodied in a small watercraft that is comprised of a hull portion defining a rider's area at the rear of the hull portion and a seat that is detachably connected to the hull portion in the rider's area and which has a rear surface positioned at the rear of the hull portion. Releasable latching means are provided for detachably securing the rear portion of the seat to the hull and operating means are provided that are accessible at a side of the seat for releasing the latching means.

DESCRIPTION OF THE PRIOR ART

Figure 1:
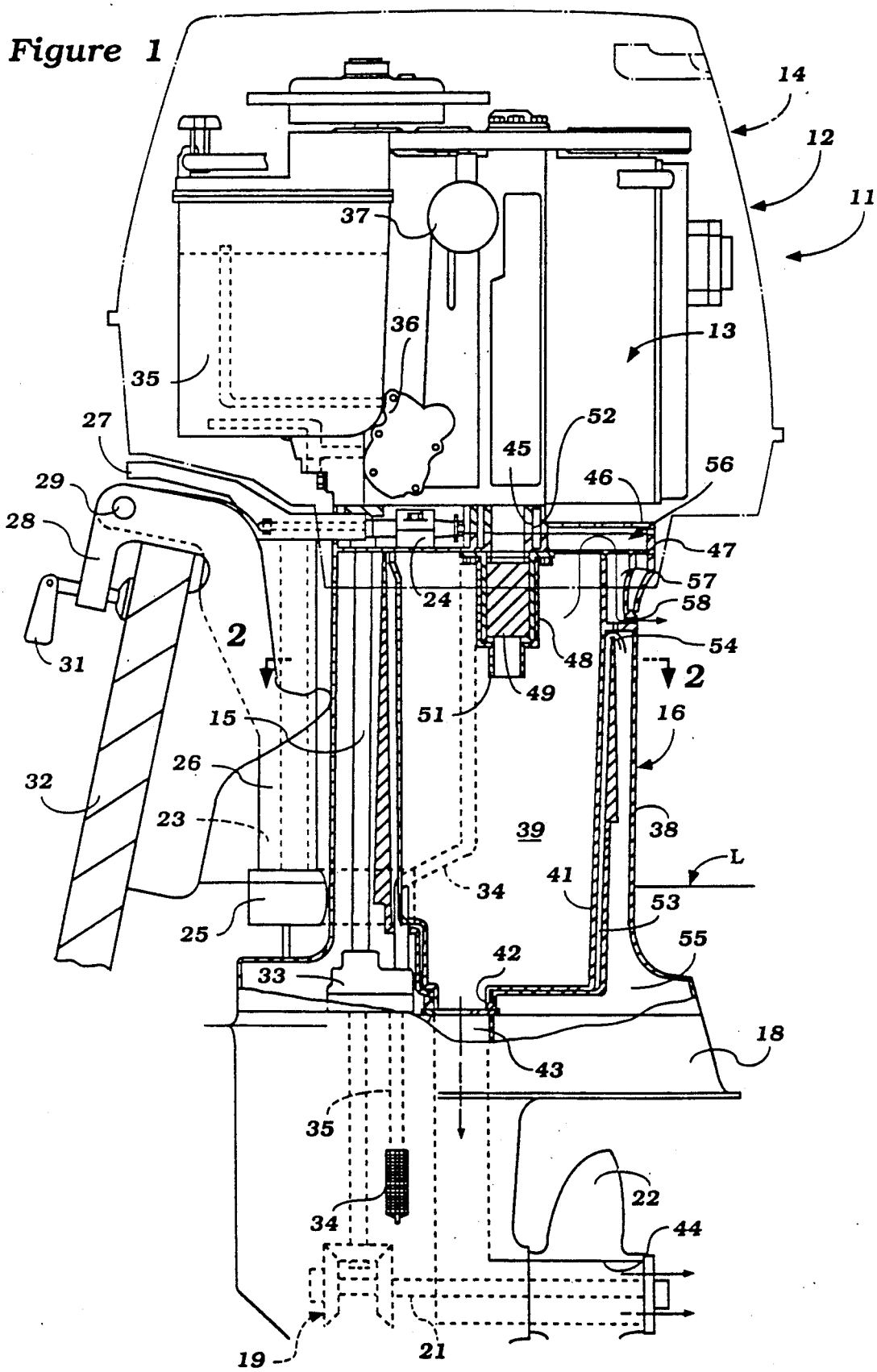
FIG. 1 is a cross sectional view taken through the rear of a small watercraft having a latching mechanism constructed in accordance with the prior art.
Figure 2:
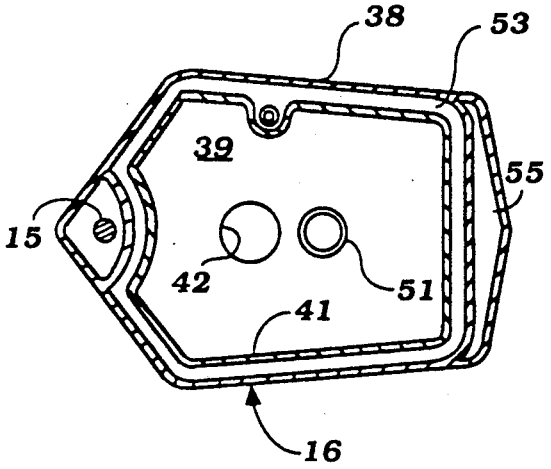
FIG. 2 is a side elevational view of the prior art latching mechanism taken in the direction of the arrow 2 in FIG. 1.

FIGS. 1 and 2 show a latching mechanism for latching a molded seat, indicated generally by the reference numeral 11 to the hull, indicated by the reference numeral 12, of a small watercraft constructed in accordance with the prior art. The portion of the seat 11 and hull 12 depicted is the rear edge of the seat. The latching mechanism is indicated generally by the reference numeral 13 and is provided at the rear edge of the seat 11 for detachably securing it in position. As is conventional, a fixed hook and keeper mechanism of a known type is provided at the forward side of the seat 11 and hull 12 for securing this portion of the seat to the hull.

The latch mechanism 13 includes a generally U-shaped keeper 14 that is affixed to a mounting plate 15 which is, in turn, affixed to the rear edge of the seat by means of bolt and nut assemblies 16.

The latching mechanism 13 is completed by means of a slideably supported latching hook 17 that has a pair of transversely spaced projections 18 that are slideable received in grooves 19 formed in a mounting plate 21. The mounting plate 21 is, in turn, affixed to the hull 12 by bolt and nut assemblies 22. The latching member 17 has an arcuate upper surface 23 that is adapted to be engaged by the keeper 14 when the seat portion 11 is reassembled onto the hull portion 12 so as to cause the latch mechanism to be released and then re-engaged.

A coil compression spring 24 engages a slideably supported plunger 25 and the latching member 17 for urging it to its latched position. The plunger 25 has a handle portion that is accessible from the rear of the watercraft so as to permit actuating of the latching mechanism 13 from this location, thus presenting the difficulties as afornoted.

DETAILED DESCRIPTION OF THE PREFERRED EMBODIMENT OF THE INVENTION

Figure 3:
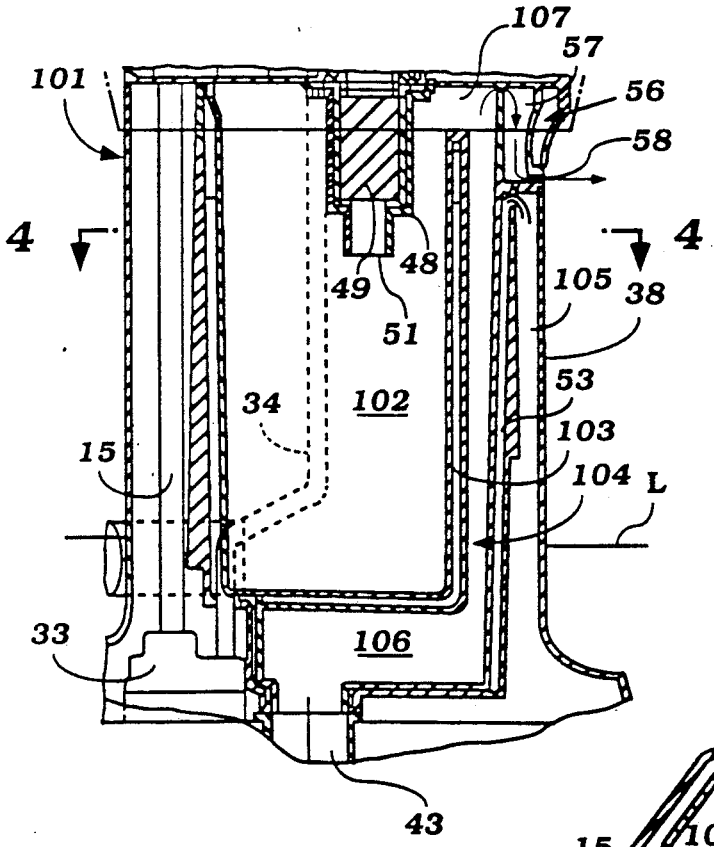
FIG. 3 is a top plane view of a small watercraft constructed in accordance with an embodiment of the invention.
Figure 4:
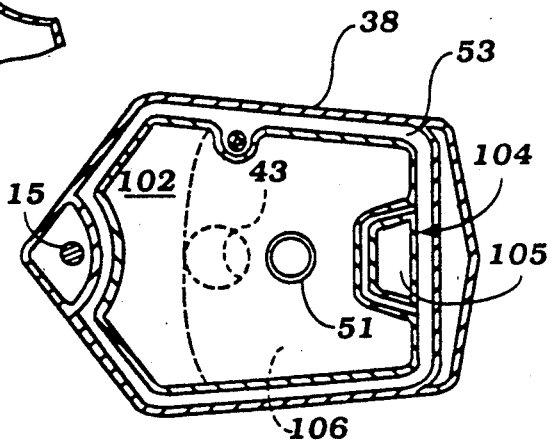
FIG. 4 is a side elevational view of the small watercraft.

Referring now to the remaining figures and initially to FIGS. 3 and 4, a small watercraft having a latching construction in accordance with an embodiment of the invention is identified generally by the reference numeral 51. The watercraft 51 is comprised of a hull that consists of a lower portion 52 and an upper or deck portion 53. The hull is formed from a molded fiberglass reinforced resin and defines a forwardly positioned engine compartment in which an internal combustion engine of a known type is positioned. The engine drives a jet propulsion unit (not shown) that is disposed beneath a rider's area, indicated generally by the reference numeral 54 and which is positioned rearwardly of a steering mast 55. The propulsion unit and powering internal combustion engine may be conventional and since the construction thereof is not necessary to understand the construction and operation of the invention, it has not been illustrated and description is not believed to be necessary.

It will be noted from the top view that the riders area 54 is defined in part by means of a pair of depressed foot wells 56 that are disposed on opposite sides of the seat, indicated by the reference numeral 11. A rider, shown in phantom and identified by the reference numeral 57 may be seated on the seat 11 in a location wherein his arms 58 may be conveniently placed on handlebars 59 of the steering tiller 55 for operation of the watercraft 51 in a known manner.

In accordance with the invention, a latch mechanism, indicated generally by the reference numeral 61, is position at the rear of the seat 11 for securing the seat 11 detachably to the hull portion 12 in a functionally similar manner to the prior art construction already described. In accordance with the invention, however, the latch mechanism 61 is formed so its operator 60 is accessible from the side rather than the rear of the seat 11 and thus a rider seated on the seat can release the latch mechanism by operating the operator 60 while still seated on the seat as shown in the phantom line view of FIG. 3.

Referring now in detail to FIGS. 5 through 8 of the drawings, the latching mechanism 61 includes a keeper assembly that is affixed to the seat 11 and which is the same as the conventional prior art construction already described. For that reason, the reference numerals applied to the prior art construction are also applied to the keeper assembly of this embodiment.

Figure 5:
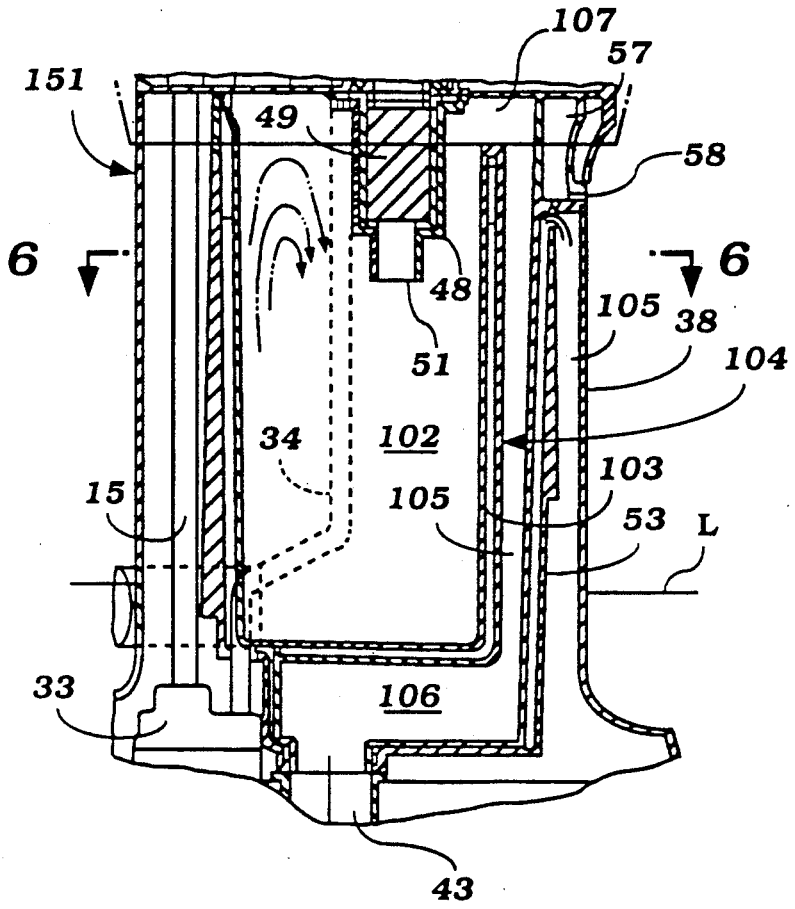
FIG. 5 is a cross sectional view, in parts similar to FIG. 1, and shows the construction of the latch mechanism in accordance with the embodiment of the invention.

The cooperating latching member, however, comprises a pivotally supported member, indicated generally by the reference numeral 62 and which is pivotally supported on a mounting bracket 63 by means of a pivot pin 64. The latching member 62 has a pair of jaws that define a latching opening 65 in which the crossbar of the keeper 14 is a adapted to be trapped when in the locked position as shown in FIG. 5 and in the solid line view of FIG. 6.

The latching member 62 has a further locking lug portion 66 that is normally engaged with a camming or locking face 67 of a slideably supported locking member 68. The locking member 68 is urged to its latched position by means of a coil compression spring 69 that is affixed between the base 63 and specifically a plate 71 that is affixed to the base 63 by means of threaded fasteners 72. The base 63 is, in turn, affixed to the hull portion 12 by means of fasteners 73.

The plate 71 and base 63 define a recess 74 in which a projection 75 of the locking member 68 is positioned. A release rod 76 is affixed to an operating shaft 77 that is journaled within the base 63. The actuating rod 76 is mounted on a cylindrical enlargement 78 of the operating shaft 77 and is eccentric to its rotational axis.

The operator 60 is comprised of a knob like member that is affixed to the exposed end of the operating shaft 77 so as to be accessible at the side of the seat as afornoted.

Figure 6:
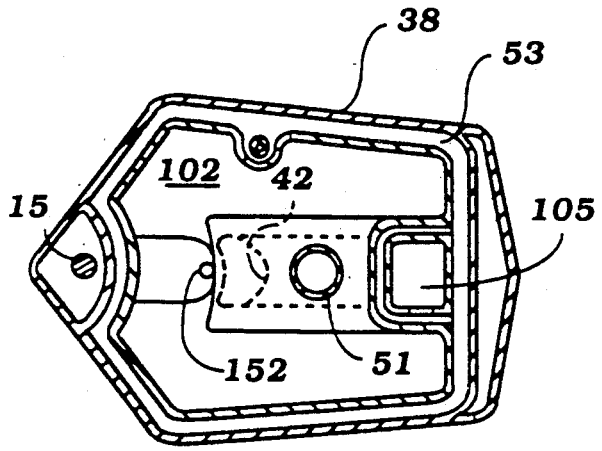
FIG. 6 is a cross sectional view taken along a plane parallel to the plane of FIG. 5 and shows the latching mechanism in the latched and released position.
Figure 7:
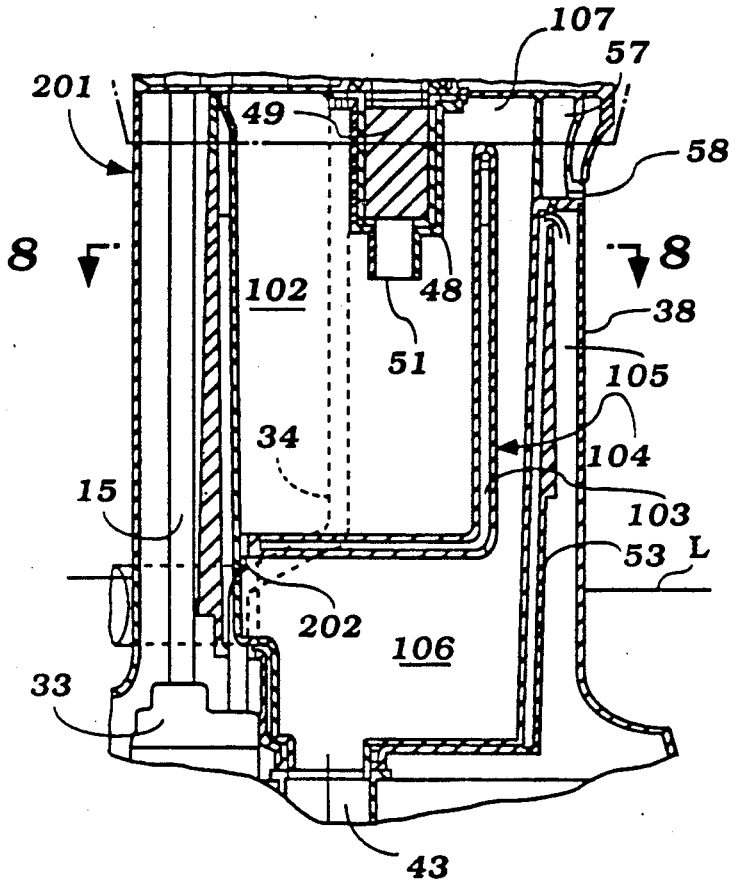
FIG. 7 is a cross sectional view taken along the line 7—7 of FIG. 6.
Figure 8:
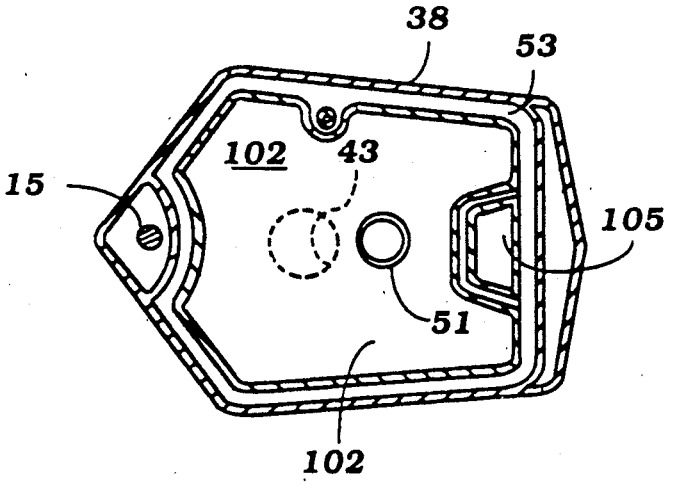
FIG. 8 is a cross sectional view, in part similar to FIG. 6, showing the latching mechanism in its released position and prior to latching thereof.
Figure 1:
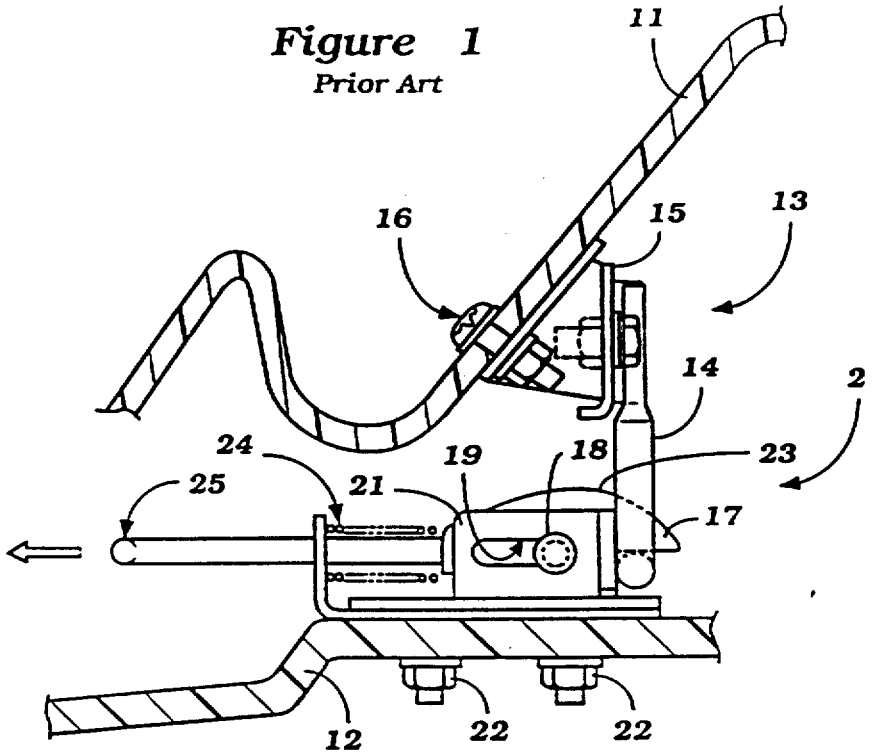
Figure 1 Prior Art
Figure 2:
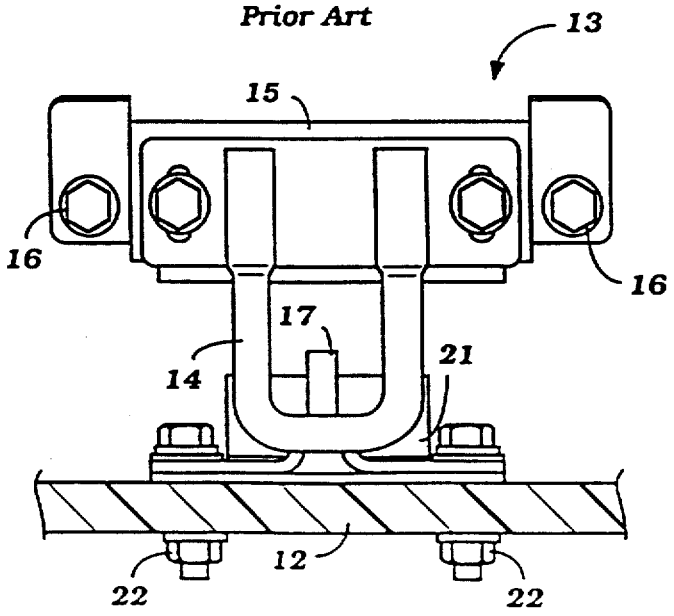
Figure 2 Prior Art
Figure 3:
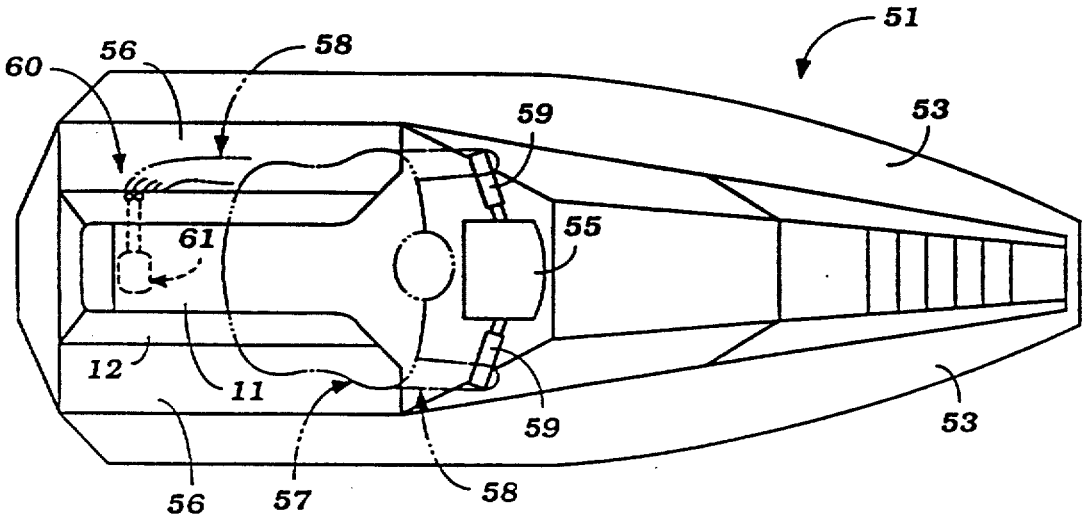
Figure 4:
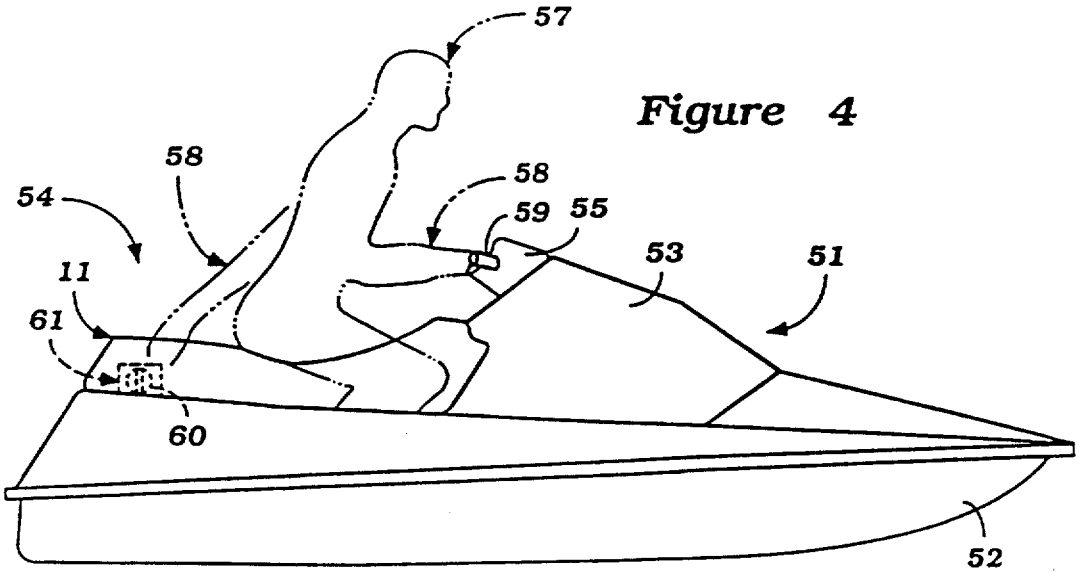
Figure 5:
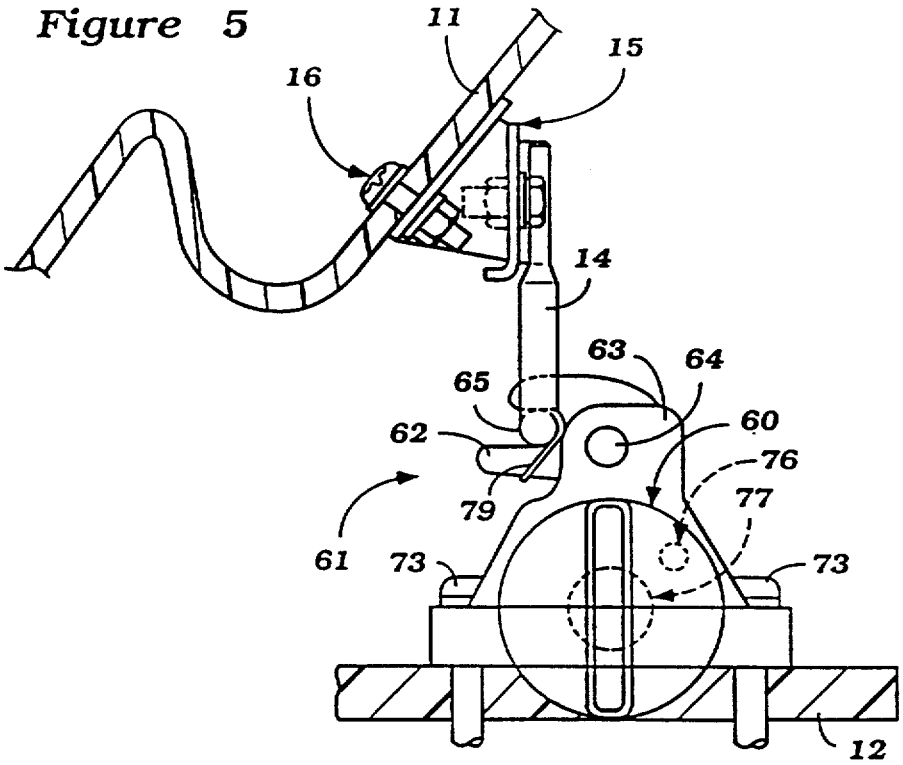
Figure 6:
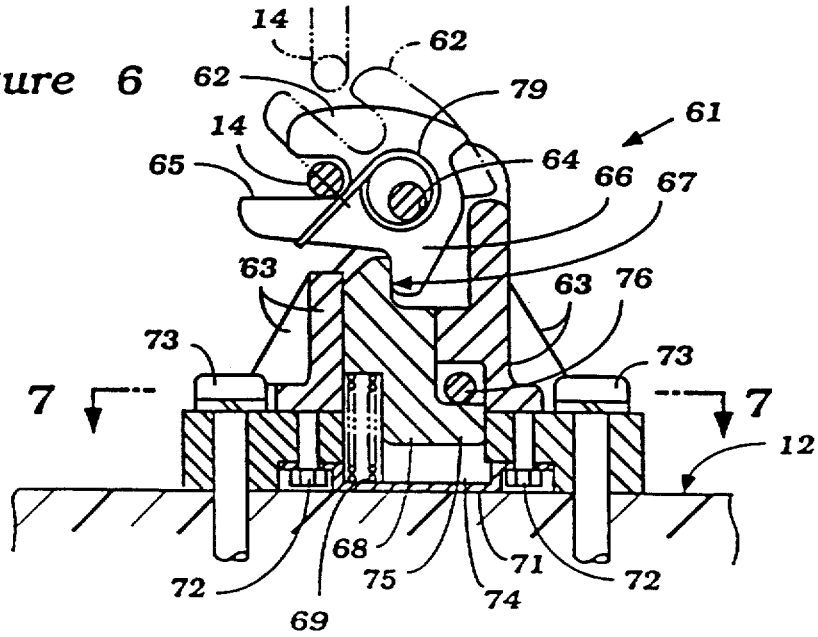
Figure 7:
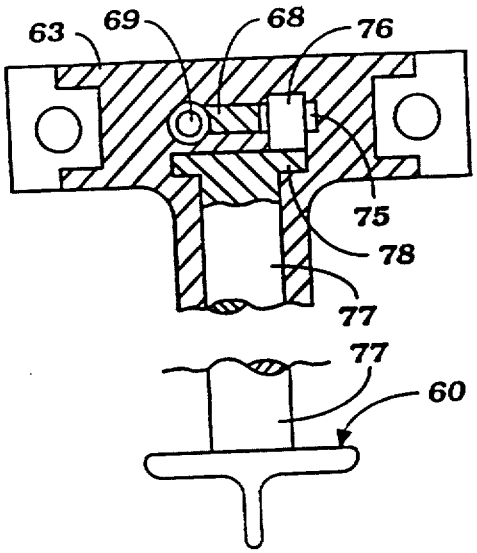
Figure 8:
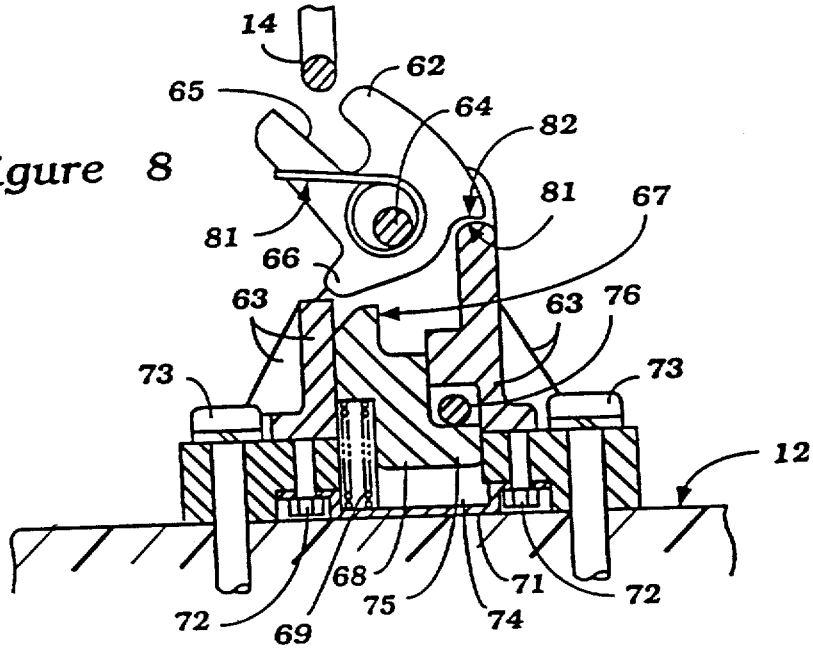

To release the latching mechanism from the position shown in FIG. 6, the operator 60 is rotated so as to move the operating shaft 77 and release rod 76 in a direction to urge the locking member 68 downwardly against the action of the coil compression spring 69. When this occurs, a torsional spring 79 will act upon the latching member 62 and urge it to the released position so that the seat 11 can be removed.

The degree of movement into this release position is limited by means of a stop shoulder 81 formed on the latch member 62 and which engages a stop shoulder 82 formed on the base 63. When the seat is reinstalled, downward movement of the seat will urge the latching member 62 to rotate against the action of the torsional spring 79 and cam the locking member 68 downwardly until it will be upwardly by the spring 69 to again retain the seat 11 in its latched position.

From the foregoing description, it should be readily apparent that an extremely simple and yet highly effect latching mechanism has been provided that may be operated by a rider seated on the seat without necessitating his leaving the watercraft and which is accessible from the side rather then the rear of the seat. It is to be understood, however, that the foregoing description is that of a preferred embodiment of the invention and various changes and modifications may be made without departing from the spirit and scope of the invention, as defined by the appended claims.

I claim:

1. A small watercraft comprised of a hull portion defining a rider's area at the rear of said hull portion, a seat detachably connected to said hull portion in said rider's area and adapted to accommodate a rider seated thereupon, releasable latching means for providing sole means for detachably affixing said seat to said hull portion, a single operating means for completely releasing said latching means and accessible by a rider while seated upon said seat wherein the rider's area and seat are configured so as to accommodate the rider seated in straddle fashion upon the seat.

2. A small watercraft as set forth in claim 1 wherein the small watercraft is jet propelled by a jet propulsion unit positioned beneath the seat.

3. A small watercraft as set forth in claim 1 where in the latching means is positioned at the rear edge of the seat.

4. A small watercraft as set forth in claim 3 wherein the operating means is accessible at the side of the seat.

5. A small watercraft as set forth in claim 4 wherein the rider's area seat are configured so as to accommodate the rider seated in straddle fashion upon the seat.

6. A small watercraft as set forth in claim 5 wherein the small watercraft is jet propelled by a jet propulsion unit positioned beneath the seat.

7. A small watercraft as set forth in claim 6 wherein the latching means comprises a generally U-shaped keeper affixed to the seat and a pivotally supported latching member carried by the hull portion for rotation about an axis transverse to the longitudinal axis of the watercraft and wherein the operator is rotatable about an axis parallel to the rotation axis of the latching member.

* * * * *

UNITED STATES PATENT AND TRADEMARK OFFICE

CERTIFICATE OF CORRECTION

PATENT NO. : 5,048,450

DATED : September 17, 1991

INVENTOR(S) : Katsunori Oka

It is certified that error appears in the above-identified patent and that said Letters Patent is hereby corrected as shown below:

--- The Patent which has been published contains incorrect drawings and enclosed is four sheets of the correct drawings consisting of eight figures. ---

--- On the Title Page, the drawing is also incorrect. ---

Signed and Sealed this

Twenty-fourth Day of August, 1993

Bruce Lehman

*Attest:*

BRUCE LEHMAN

*Attesting Officer*

*Commissioner of Patents and Trademarks*

United States Patent [19]

Oka

[11] Patent Number: 5,048,450

[45] Date of Patent: Sep. 17, 1991

[54] SEAT LATCH FOR WATERCRAFT

[75] Inventor: Katsunori Oka, Iwata, Japan

[73] Assignee: Yamaha Hatsudoki Kabushiki Kaisha, Iwata, Japan

[21] Appl. No.: 450,608

[22] Filed: Dec. 13, 1989

[30] Foreign Application Priority Data

Dec. 14, 1988 [JP] Japan ..... 63-317042

[51] Int. Cl.[5] ..... B63B 35/84

[52] U.S. Cl. ..... 114/363; 114/270; 297/193

[58] Field of Search ..... 114/363, 270, 343; 297/188, 192, 193, 195, 311; 220/4.22, 7, 212, 244, 245, 252, 315, 324, 334

[56] References Cited

U.S. PATENT DOCUMENTS 3,718,365 2/1973 Gibson ..... 114/363

3,726,249 4/1973 Watkins ..... 114/270

FOREIGN PATENT DOCUMENTS 8803109 5/1988 World Int. Prop. O. ..... 114/270

OTHER PUBLICATIONS

Ski Horse, 10/19/84, Ski Horse of Penna., Johnstown, Pa.

Seat Frame, SBLP-186, Fab Tech, Cape Coral, Fla., 10/17/88.

*Primary Examiner*—Sherman Basinger

*Assistant Examiner*—Stephen P. Avila

*Attorney, Agent, or Firm*—Ernest A. Beutler

[57] ABSTRACT

A small watercraft having a detachable seat that is affixed to the hull by a latching mechanism that is positioned at the rear of the seat and which is operated by an operator accessible at the side of the seat and by a rider seated on the seat when he is positioned thereon.

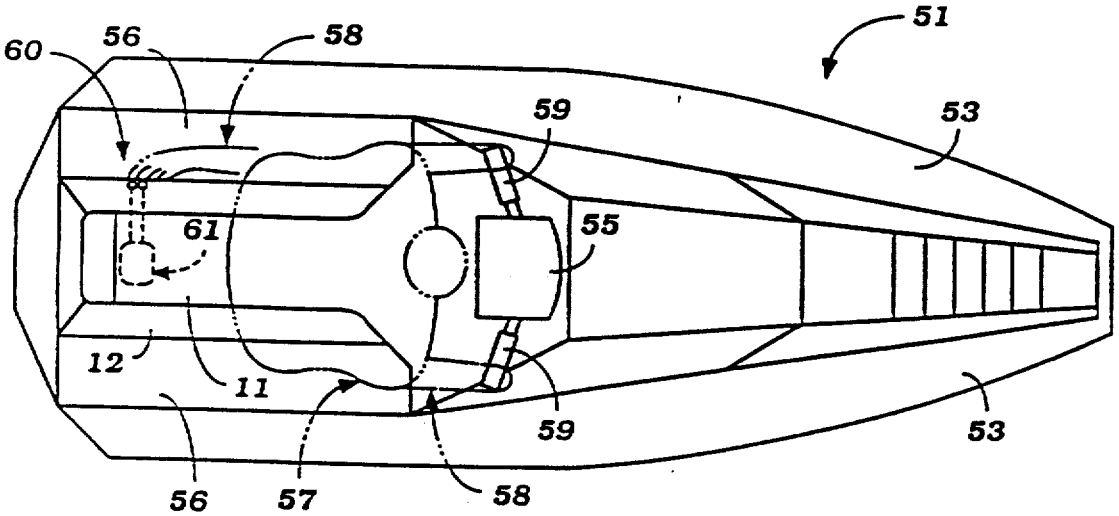

7 Claims, 4 Drawing Sheets